US008529226B2

(12) United States Patent
Li

(10) Patent No.: US 8,529,226 B2
(45) Date of Patent: Sep. 10, 2013

(54) BLADELESS AIR FAN

(75) Inventor: De-Zheng Li, Nanxiong (TW)

(73) Assignee: Kable Enterprise Co., Ltd., Taipei (TW)

( * ) Notice: Subject to any disclaimer, the term of this patent is extended or adjusted under 35 U.S.C. 154(b) by 223 days.

(21) Appl. No.: 13/221,687

(22) Filed: Aug. 30, 2011

(65) Prior Publication Data

US 2012/0318392 A1 Dec. 20, 2012

(30) Foreign Application Priority Data

Jun. 16, 2011 (TW) ..... 100210924 U

(51) Int. Cl.
*F15D 1/00* (2006.01)

(52) U.S. Cl.
USPC ..... 417/423.14; 417/177; 239/265.17; 239/434.5; 239/561

(58) Field of Classification Search
USPC .... 417/177, 313, 423.9, 423.14; 239/265.17, 239/434.5, 561, 568, DIG. 7
See application file for complete search history.

(56) References Cited

U.S. PATENT DOCUMENTS 8,052,379 B2 * 11/2011 Gammack ..... 415/126
2009/0060710 A1 3/2009 Gammack et al.

FOREIGN PATENT DOCUMENTS

GB 2468330 A * 9/2010
GB 2475425 A * 5/2011
KR 985378 B1 * 10/2010
TW M394383 12/2010
TW M398032 2/2011

* cited by examiner

*Primary Examiner* — Peter J Bertheaud
*Assistant Examiner* — Dominick L Plakkoottam
(74) *Attorney, Agent, or Firm* — Muncy, Geissler, Olds & Lowe, PLLC

(57) ABSTRACT

A bladeless air fan includes a host and an airflow guiding frame. The host divides into a housing section to hold an airflow generator and a pivoting section to include two first pivoting portions. The airflow generator is connected to an airflow guiding manifold extended from the housing section to the pivoting section. The airflow guiding frame includes an air discharging portion and an airflow guiding passage and two second pivoting portions being annular to form two air intake ports communicating with the airflow guiding passage. The second pivoting portions are rotatably coupled with the first pivoting portions such that the airflow guiding passage communicates with the airflow guiding manifold. The air discharging portion encircles an airflow passage being formed at an inner diameter allowing the housing section to pass through to enlarge the range of the second pivoting portions rotating against the first pivoting portions.

17 Claims, 7 Drawing Sheets

BLADELESS AIR FAN

FIELD OF THE INVENTION

The present invention relates to a bladeless air fan and particularly to a bladeless air fan that has an improved air discharge structure to realize a greater air discharge rotational angle and improve air delivery.

BACKGROUND OF THE INVENTION

An air fan relies on spinning blades to pressurize air to generate airflow. A conventional air fan has exposed blades driven by a motor to get spinning and a mesh type frame to surround the blades to avoid hurting people. But the frame still has gaps and small children could poke fingers inadvertently through the gaps of the frame and be injured by the high speed spinning blades. The frame also cannot prevent small articles from piercing through, hence small children could also insert incidentally playing articles into the frame to damage the articles or the blades. Moreover, the frame cannot prevent dust from accumulating on the blades. Unless the fan is washed and cleaned frequently the spinning blades could throw a great amount of dust outside to cause allergic implications on respiratory organs and skin of people after a prolonged period of time, or even inflict ailments.

Hence improvements of air fan have been constantly made. Now bladeless air fans with hidden blades have been developed and introduced on the market. For instance, R.O.C. Pat. No. M398032 entitled "Bladeless air fan" includes a base and a holder fastened to the base to house a motor, and a set of blades hinged on the motor. The holder has a latch portion on the top connecting to an air discharging portion which is a circular frame and has a slit air outlet behind the inner rim. The motor drives the blades spinning. Airflow generated by the blades blows upwards and is discharged through an annular air outlet at the air discharging portion. The blades are hidden in the holder without the risk of injuring children during spinning, and dust accumulating on the blades also can be reduced, and spreading of the dust can also be further reduced through the air discharging portion. However, its air outlet is located at the inner rear side of the air discharging portion and formed in a tortuous manner, airflow resistance passing through the air outlet increases and results in decrease of airflow power. As a result, the airflow power generated by the bladeless air fan is significantly smaller than the general air fan. The bladeless air fan is more expensive but does not provide desirable performance, hence is not well accepted on the market.

R.O.C. Pat. No. M394383 entitled "Bladeless air fan" provides another type of bladeless air fan that includes a frame and an airflow guiding means. The frame has an airflow passage and at least one airflow orifice set. The airflow guiding means is connected to the frame and has a hollow airflow guiding frame and an airflow guiding set. The airflow guiding frame has an airflow guiding passage communicating with the airflow passage. The airflow guiding set is located at a selected position in the airflow guiding passage to direct airflow direction and airflow speed of the air in the airflow guiding passage. Its airflow passage further is divided into an air intake passage and an air discharge passage. It also has a number of air inlets and air outlets formed alternately and annularly on the inner rim of the frame. It also has the drawback of inadequate airflow amount like the previous reference. In the reference of M398032 the annular air outlet surrounding the entire air discharging portion still cannot provide a greater amount of airflow. In the reference of M394383, with the air inlets and outlets located on the inner rim of the frame, the problem of inadequate airflow power also is unavoidable.

U.S. Pub. No. 2009/0060710 discloses another type of air fan to provide improved airflow discharge. It is a bladeless air fan including a nozzle, a device for creating an airflow through the nozzle and a mouth to channel the airflow in the nozzle. The mouth is located behind the inner rim of the nozzle. The mouth has a Coanda surface on the circumference. Through the Coanda effect of fluid kinetics the airflow tends to adhere to the Coanda surface and change the flow direction so that the airflow shifts to exit via the mouth at the rear side of the inner rim. While it has the advantage of balanced airflow because of the Coanda effect, the shifted airflow also generates resistance to the airflow and results in lower airflow exit speed.

In short, the aforesaid conventional techniques have the airflow generator located below the frame and result in constraint of frame swiveling. The conventional air discharge design also does not produce sufficient airflow power. There is still room for improvement.

SUMMARY OF THE INVENTION

In view of the conventional bladeless air fans still have technical deficiency the primary object of the present invention is to provide an improved bladeless air fan to overcome that technical deficiency.

The present invention provides a bladeless air fan. The bladeless air fan includes a host and an airflow guiding frame. The host includes a housing section and a pivoting section. The housing section holds an airflow generator. The pivoting section includes two first pivoting portions. The airflow generator is connected to an airflow guiding manifold extended from the housing section to the pivoting section and communicating with the first pivoting portions. The airflow guiding frame has an air discharging portion, two second pivoting portions and an airflow guiding passage located in the air discharging portion. The two second pivoting portions are annular to form two air intake ports communicating with the airflow guiding passage. The air discharging portion encircles an airflow passage to allow air to pass through axially. The second pivoting portions are rotatably coupled with the first pivoting portions such that the airflow guiding passage communicates with the airflow guiding manifold. The airflow passage is formed at an inner diameter allowing the housing section to pass through to enlarge the range of the second pivoting portions rotating against the first pivoting portions.

By means of the features set forth above, the air discharging portion can be rotated beyond the housing space of the host without being hindered, thus increasing the range of the rotation of the air discharging portion.

Moreover, the air discharging portion includes an airflow gathering wall, and an inner ring compression wall and an outer ring compression wall extended forwards from two ends of the airflow gathering wall. From the junctions of the airflow gathering wall and inner ring compression wall and outer ring compression wall, the inner ring compression wall and outer ring compression wall are spaced from each other at a gradually decreasing distance between them, and the inner ring compression wall and outer ring compression wall also have distal ends by a gap to form a front air outlet to discharge airflow forwards. Such a design can increase airflow speed and enhance airflow convergence.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
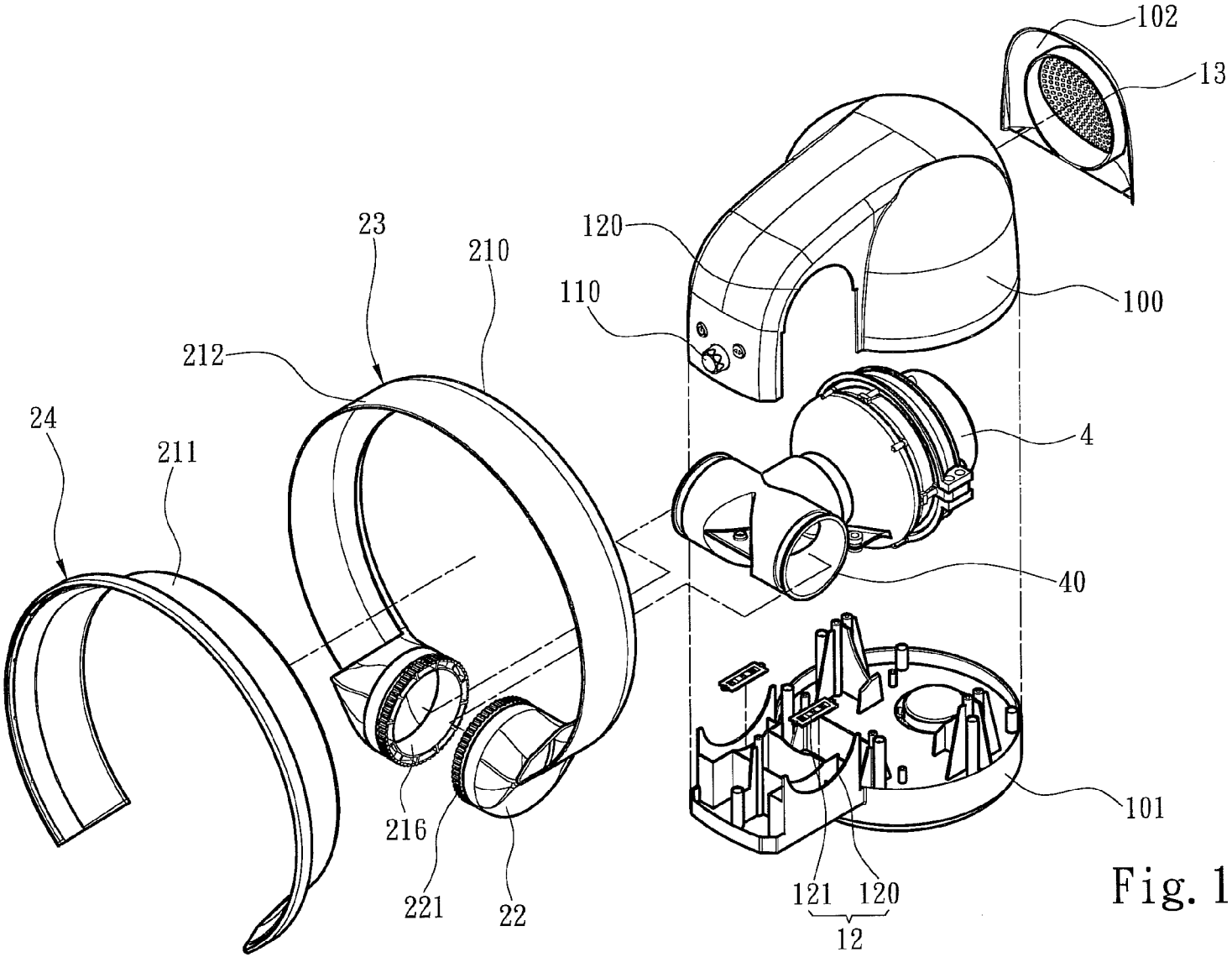
FIG. 1 is an exploded view of the bladeless air fan of the invention.
Figure 2:
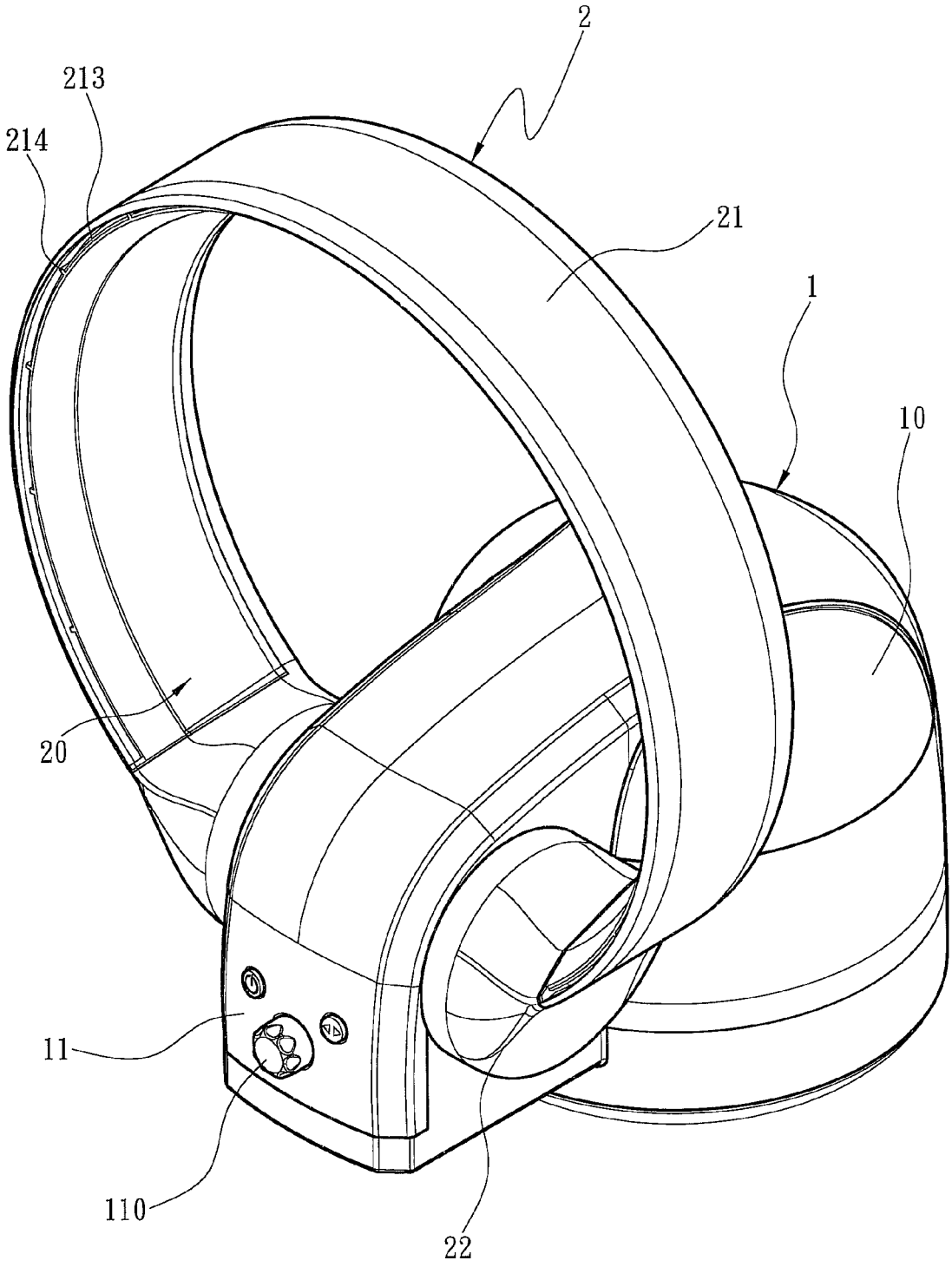
FIG. 2 is a perspective view of the bladeless air fan of the invention.
Figure 7:
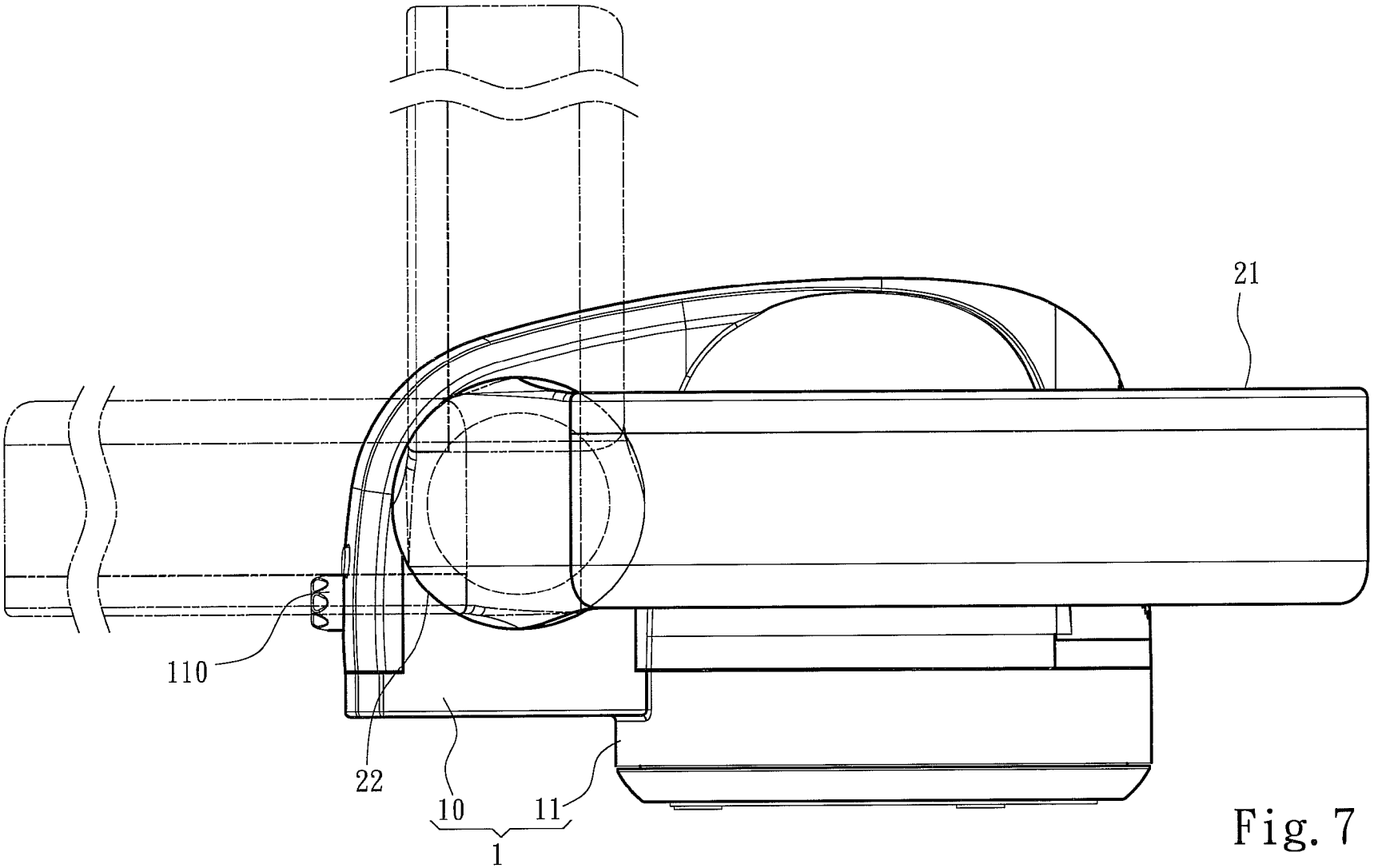
FIG. 7 is a schematic view of the invention showing the air discharging portion rotating against the host.

Please referring to FIGS. 1 and 2, the present invention aims to provide a bladeless air fan. The bladeless air fan includes a host 1 and an airflow guiding frame 2. FIG. 1 shows an embodiment in which the host 1 includes an upper case 100, a lower case 101 and a rear case 102. The embodiment shown in FIGS. 1 and 2 is merely a preferable structural embodiment of the host 1 and not the limitation thereof. Modifications of the cases and profiles can be made easily by those skilled in the art and shall be included in the scope of this invention. The host 1 is divided into a housing section 10 and a pivoting section 11 extending from the housing section to hold an airflow guiding manifold 40. The housing section 10 holds an airflow generator 4 connecting to the airflow guiding manifold 40. The airflow guiding manifold 40 is extended from the housing section 10 to the pivoting section 11. The rear case 102 has a plurality of air inlets 13 formed at one side of the airflow generator 4 opposite to the airflow guiding manifold 40 to smooth the airflow path entering the airflow generator 4 to increase airflow volume. It is to be noted that the location of the air inlets 13 is not limited on the rear case 102, any other alterations thereof can be known by those skilled in the art and shall also be included in the scope of this invention. The pivoting section 11 has two first pivoting portions 12 communicating with the airflow guiding manifold 40 and a plurality of control portions 110 to control operation of the bladeless air fan. The airflow guiding frame 2 includes an air discharging portion 21 and a second pivoting portion 22. FIGS. 1 and 2 show that the air discharging portion 21 encircles an airflow passage 20 to allow air to pass through axially. The second pivoting portion 22 and the air discharging portion 21 form an airflow guiding passage 215 inside (also referring to FIG. 3). The second pivoting portion 22 is annular to form two air intake ports 216 communicating with the airflow guiding passage 215. In the embodiment shown in FIGS. 1 and 2, the airflow guiding frame 2 includes a first frame 23 and a second frame 24, however this is not the limitation of the composing elements or assembly of the airflow guiding frame 2. Alterations thereof can be made easily by those skilled in the art and shall also be included in the scope of this invention. The second pivotal portion 22 is rotatably coupled with the first pivoting portion 12. As the first pivoting portion 12 communicates with the airflow guiding manifold 40, pivotal coupling of the first and second pivoting portions 12 and 22 also allows the airflow guiding manifold 40 to communicate with the airflow guiding passage 215 so that airflow generated by the airflow generator 4 can enter the airflow guiding passage 215 and be discharged through the air discharging portion 21. Moreover, due to the first and second pivoting portions 12 and 22 are rotatable relative to each other, and the air discharging portion 21 can rotate about the first and second pivoting portions 12 and 22. In addition, the inner rim of the air discharging portion 21, i.e. the airflow passage 20 being formed at an inner diameter allowing the housing section 10 to pass through, the air discharging portion 21 can continuously rotate beyond the housing section 10 without being hindered, thus the second pivoting portion 22 having a greater range of rotating against the first pivoting portion 12 (referring to FIG. 7). Preferably, the first and second pivoting portions 12 and 22 are allowed to rotatae relative to each other for 360 degrees.

Referring to FIGS. 1 and 2, in this embodiment the first pivoting portion 12 includes two openings 120 surrounded by the upper case 100 and lower case 101 and a plurality of retaining elastic reeds 121 held in the openings 120. The second pivoting portion 22 is rotatable and retained in the openings 120. The second pivoting portion 22 also includes a gear 221 located in the openings 120. Operation of the gear 221 and retaining elastic reeds 121 will be discussed later. The air discharging portion 21 includes an airflow gathering wall 210, an inner ring compression wall 211 and an outer ring compression wall 212. The inner ring compression wall 211 and outer ring compression wall 212 have respectively a distal end spaced from each other by a gap to form a front air outlet 213 which is divided by at least one spacer 214 inside.

Figure 3:
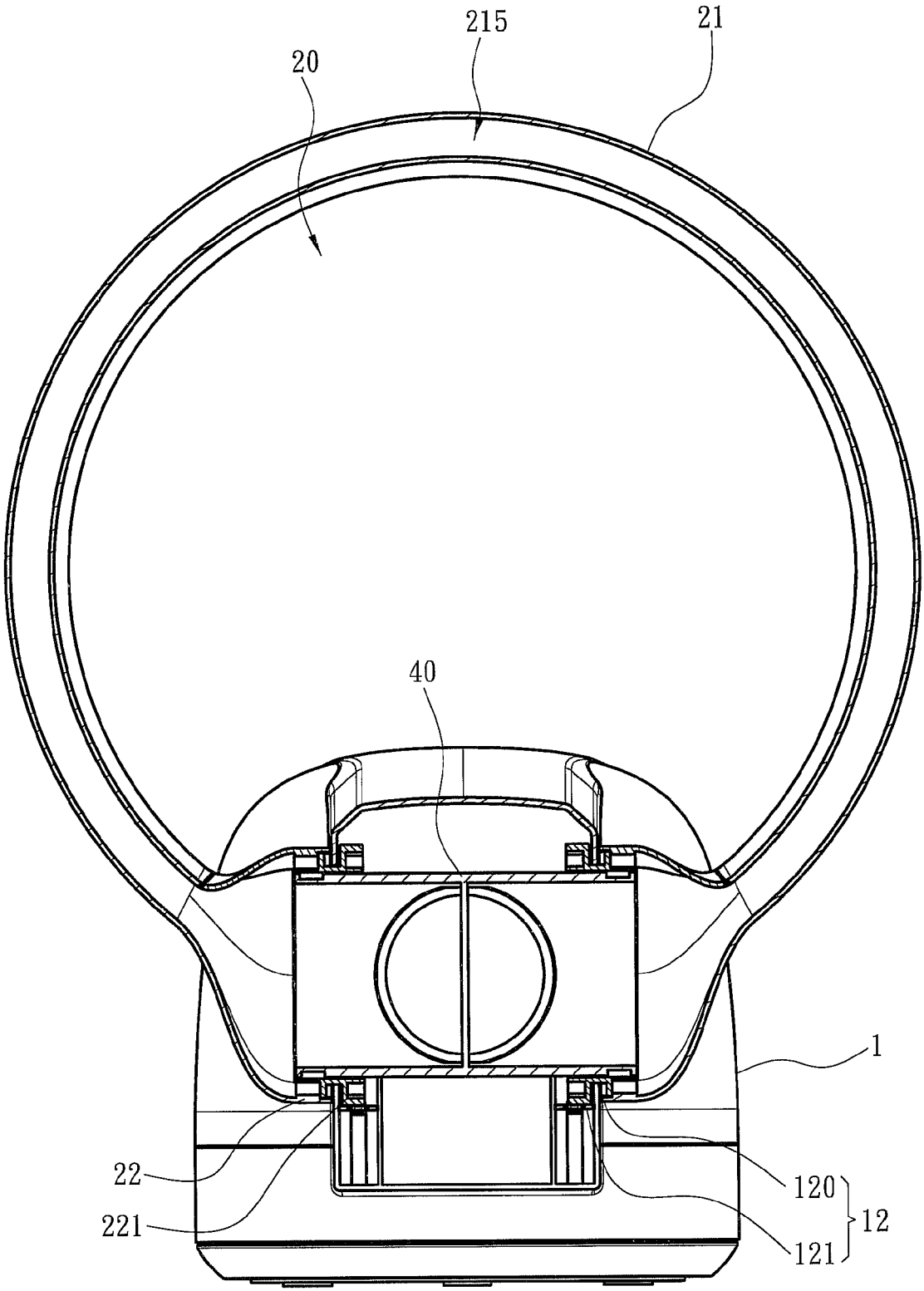
FIG. 3 is a front view of the bladeless air fan of the invention.

Please refer to FIG. 3 for the sectional view of the airflow guiding frame 2 and pivoting section 11. The second pivoting portion 22 is rotatable and retained in the openings 120 of the first pivoting portions 12. The gear 221 of the second pivoting portion 22 butts the retaining elastic reed 121. The second pivoting portion 22 is inserted into the openings 120 so that the airflow guiding passage 215 communicates with the airflow guiding manifold 40 having two passages to direct the airflow delivered from the airflow generator 4 into the airflow guiding passage 215. Also refer to FIGS. 4 and 5 for the sectional views of the pivoting section 11, with the second pivoting portion 22 inserted into the openings 120 to butt the retaining elastic reeds 121. Each retaining elastic reed 121 has an elastic flange 122 to engage with the gear 221 to position the airflow guiding frame 2 on the host 1 at a selected angle. The retaining elastic reed 121 also has elasticity to allow the elastic flange 122 to be moved and bounce back. Hence when the airflow guiding frame 2 rotates against the host 1 by forces, the gear 221 is turned to push the elastic flange 122 to retreat or return so that the airflow guiding frame 2 can be rotated against the host 1, and positioned at a selected angle through the engagement of the elastic flange 122 and gear 221.

Figure 4:
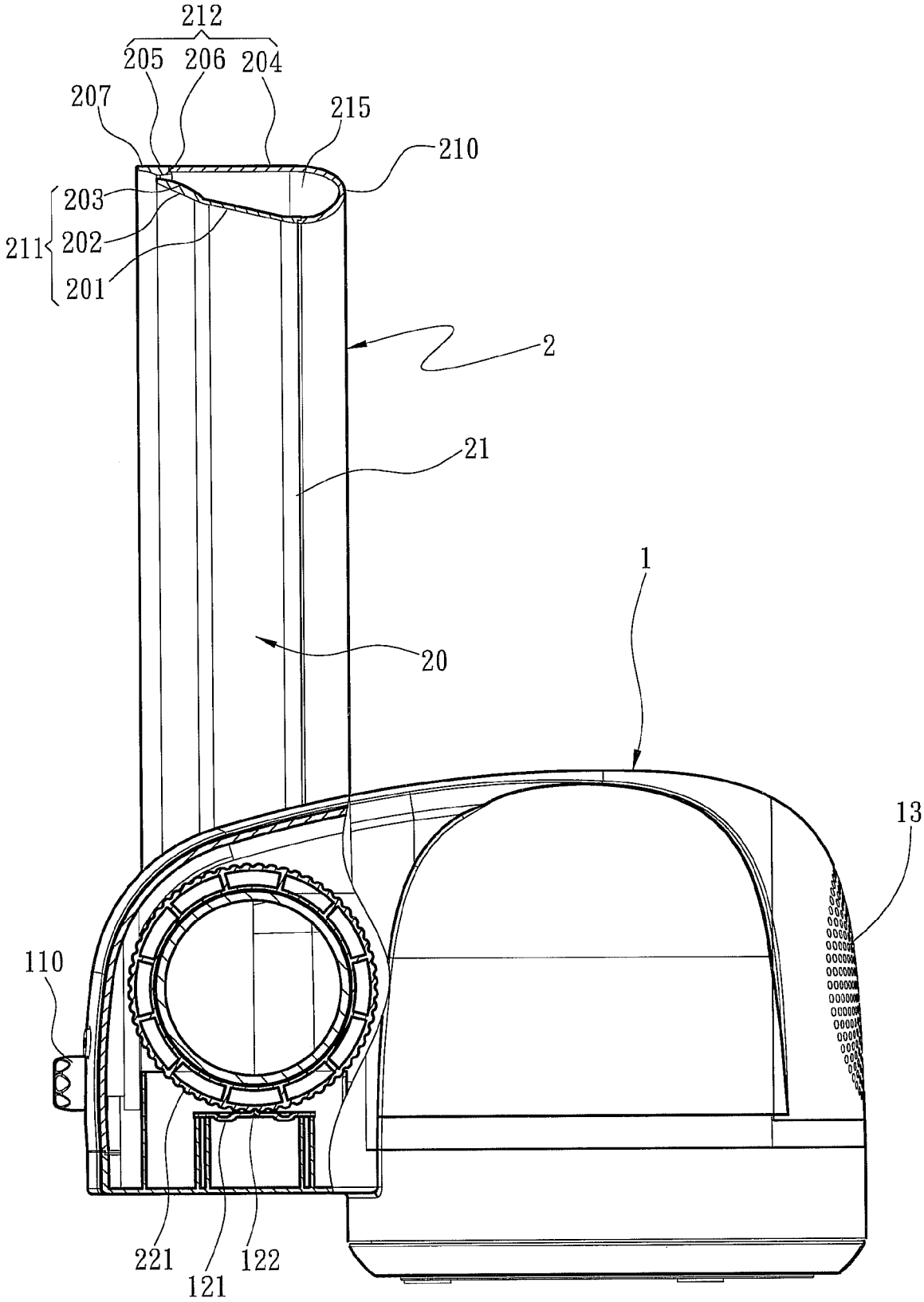
FIG. 4 is a side sectional view of the bladeless air fan of the invention.
Figure 5:
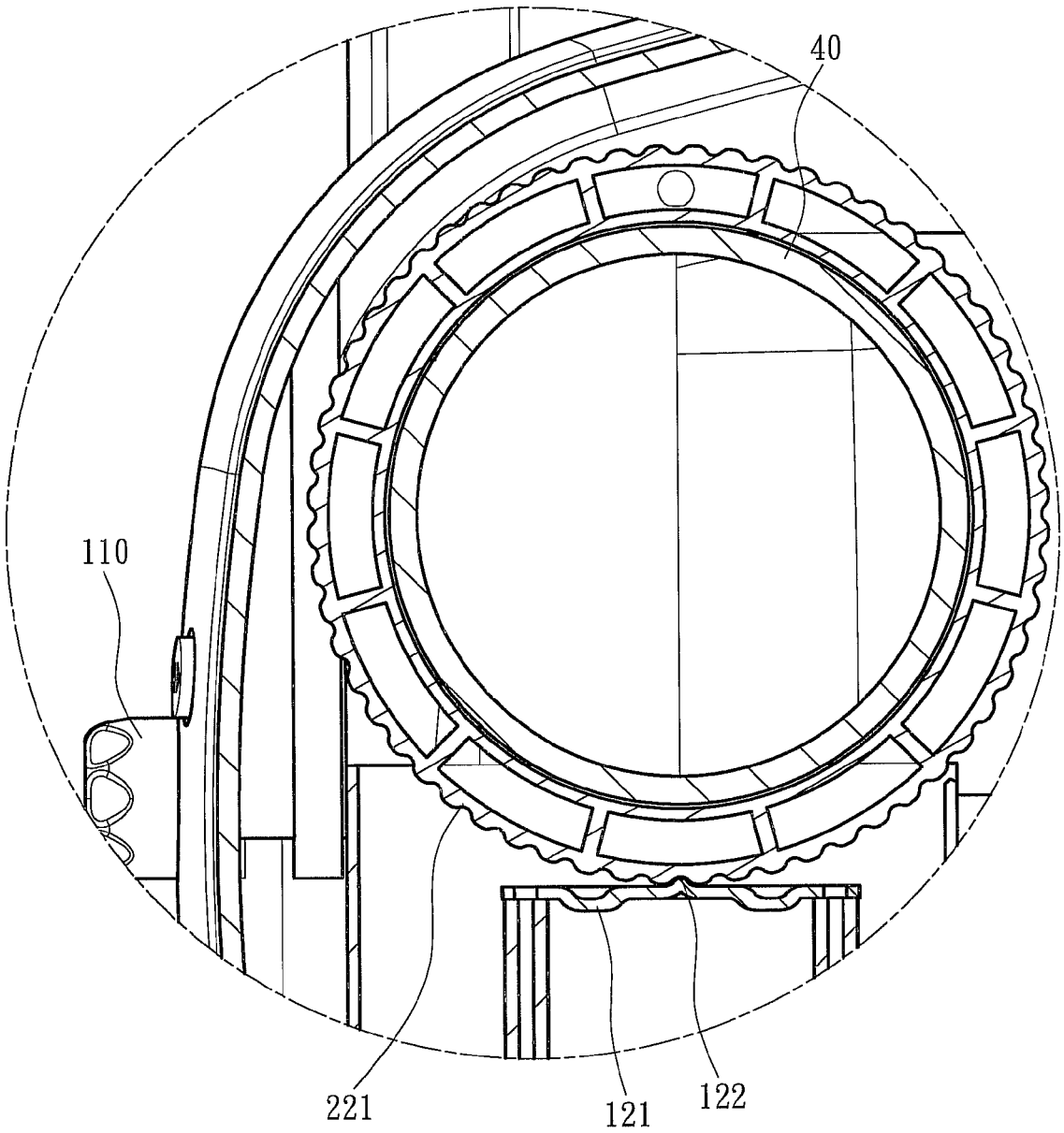
FIG. 5 is an enlarged fragmental view of a portion of the bladeless fan of FIG. 4.
Figure 6:
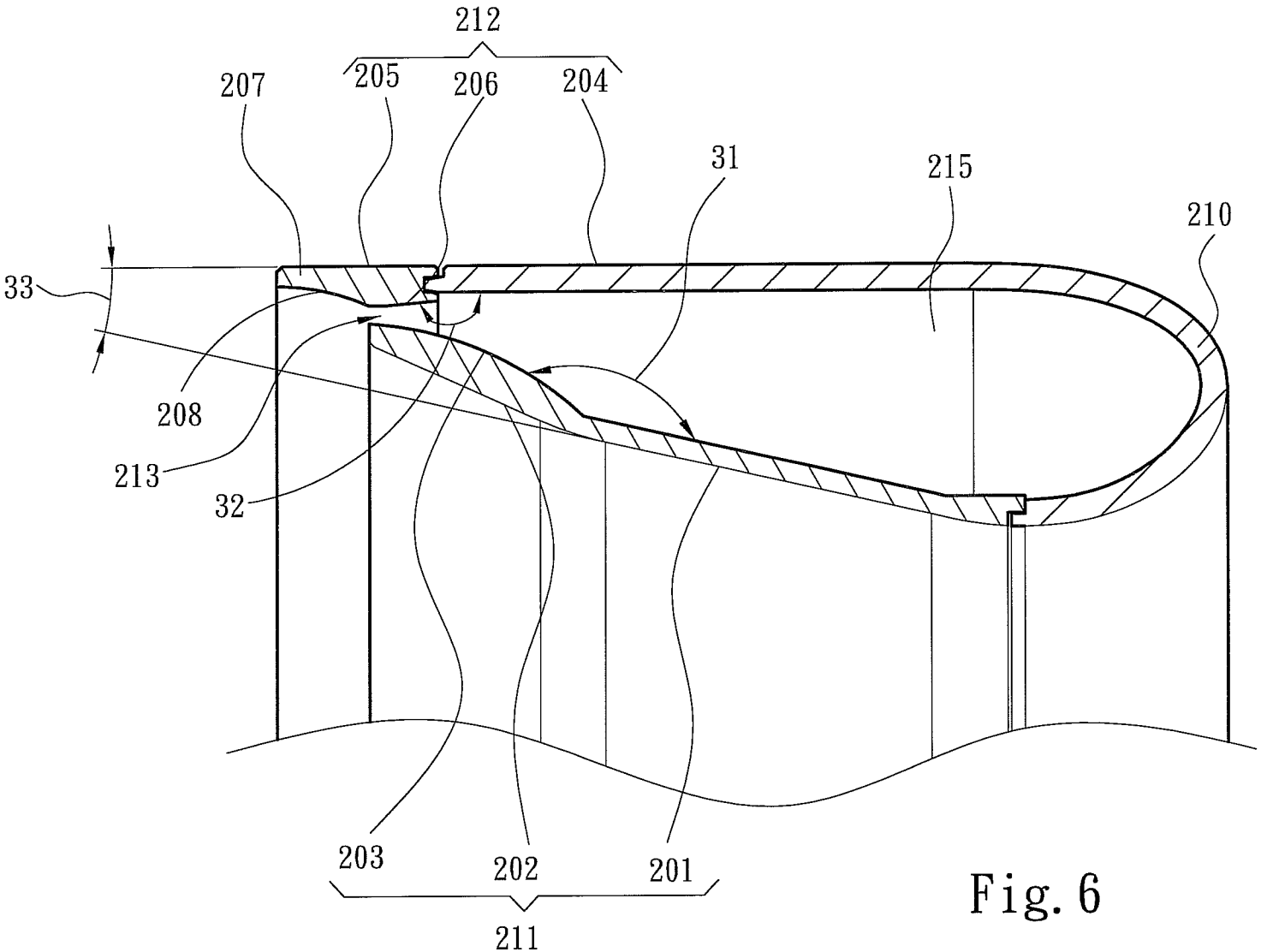
FIG. 6 is an enlarged sectional detail of the air discharging portion.

Also referring to FIGS. 4 and 6, the airflow gathering wall 210 is bent in a U shape to form a greater space inside to allow the airflow provided by the airflow generator 4 to rapidly enter the air discharging portion 21. The airflow gathering wall 210 has two ends extended respectively forwards to form the inner ring compression wall 211 and outer ring compression wall 212. From the junctions of the airflow gathering wall 210 and the inner ring compression wall 211 and outer ring compression wall 212 the inner ring compression wall 211 and outer ring compression wall 212 are spaced from each other at a gradually shrinking distance between them. The inner ring compression wall 211 further has a first extension 201 and a first compression section 202 which has a first compression convex rim 203 on the inner side extended to the front air outlet 213. The first compression convex rim 203 and first extension 201 form a first included angle 31 between 130 and 160 degrees, preferably 145 degrees. Similarly, the outer ring compression wall 212 further has a second extension 204 and a second compression section 205 which has a second compression convex rim 206 on the inner side with the surface extended to the front air outlet 213. The second compression convex rim 206 and second extension 204 also form a second included angle 32 between 140 and 175 degrees, preferably 175 degrees. More specifically, the outer ring compression wall 212 is extended flatly from the airflow gathering wall 210, and the inner ring compression wall 211 is inclined towards the outer ring compression wall 212 at an angle so that a third included angle 33 is formed between the inner ring compression wall 211 and outer ring compression wall 212. The third included angle 33 is between 10 and 15 degrees, preferably 11 degrees. The second compression section 205 further is extended to form a guiding section 207 beyond the front air outlet 213 that has a guiding surface 208 to direct airflow discharged from the front air outlet 213 so that a portion of the airflow can be guided along the guiding surface 208 to form converged airflow blowing forwards without spreading outward. FIGS. 4 and 6 illustrate an embodiment of the guiding surface 208 in an arched surface, but the guiding surface 208 can also be a flat surface. By means of the design of the air discharging portion 21 previously discussed the inner ring compression wall 211 and outer ring compressing wall 212 form a shrinking gap between them towards the front air outlet 213 so that a greater space is provided inside the airflow gathering wall 210 to allow the airflow generated by the airflow generator 4 to rapidly enter the air discharging portion 21. The shrinking interval between the inner ring compression wall 211 and outer ring compressing wall 212 also accelerates airflow speed. Moreover, according fluid mechanics, the first included angle 31 between the first compression convex rim 203 and first extension 201 can produce a first stage compression on the airflow passing through, and the second included angle 32 between the second compression convex rim 206 and second extension 204 can produce a second stage compression on the airflow passing through. After this two-stage compression, a high speed airflow at a greater volume is discharged through the front air outlet 213.

In addition, the air discharging portion 21 can rotate against the host 1 about the first and second pivoting portions 12 and 22 at a greater angle to provide a wider air discharge range.

As a conclusion, the present invention provides many advantages, notably:

1. Airflow in the airflow guiding frame 2 does not turn at a great angle, hence airflow resistance is smaller, and airflow discharge speed is faster.

2. Due to smaller airflow resistance the airflow generator 4 of a given power can provide a greater amount of airflow than the conventional techniques.

3. With increased airflow speed and amount, electric power consumption is smaller for a given performance requirement, hence environmental-friendly and energy-saving effect can also be accomplished 4. Since the airflow guiding frame 2 can rotate against the host 1 at a greater angular range, a greater range of airflow discharge can be provided.

While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. A bladeless air fan, comprising: a host divided into a housing section and a pivoting section extending from the housing section to hold an airflow guiding manifold, the housing section holding an airflow generator, the pivoting section including two first pivoting portions, the airflow generator being connected to the airflow guiding manifold, the airflow guiding manifold being extended from the housing section to the pivoting section and communicating with the first pivoting portions; and an airflow guiding frame which includes an air discharging portion, two second pivoting portions, and an airflow guiding passage formed in the air discharging portion, the second pivoting portions being annular to form two air intake ports communicating with the airflow guiding passage, the air discharging portion encircling an airflow passage to allow air to pass through axially, the second pivoting portions being rotatably coupled to the first pivoting portions such that the airflow guiding passage communicates with the airflow guiding manifold, the air flow passage being formed at an inner diameter of the airflow guiding frame such that the housing section is allowed to pass through the air flow passage in order to increase the pivotable range of the first pivoting portions with respect to the second pivoting portions.

2. The bladeless air fan of claim 1, wherein the first pivoting portions are two openings formed on the pivoting section, the second pivoting portions being rotatable and retained in the two openings.

3. The bladeless air fan of claim 2, wherein each first pivoting portions further includes a retaining elastic reed in the opening, each second pivoting portion including a gear located in the opening, the retaining elastic reed including an elastic flange engagable with the gear and being resilient to be pushed by the gear during rotation of the airflow guiding frame to retreat and return.

4. The bladeless air fan of claim 1, wherein the housing section further includes a plurality of air inlets at one side of the airflow generator opposite to the airflow guiding manifold.

5. The bladeless air fan of claim 1, wherein the air discharging portion includes an airflow gathering wall, an inner ring compression wall and an outer ring compression wall extended forwards respectively from two ends of the airflow gathering wall, the inner ring compression wall and the outer ring compression wall being spaced from each other at a gradually shrinking distance from junctions of the airflow gathering wall and the inner ring compression wall and the outer ring compression wall, the inner ring compression wall and the outer ring compression wall including respectively a distal end spaced from each other by a gap to form a front air outlet to discharge airflow forwards.

6. The bladeless air fan of claim 5, wherein the front air outlet includes at least one spacer.

7. The bladeless air fan of claim 5, wherein the inner ring compression wall further includes a first extension and a first compression section which includes a first compression convex rim on an inner side thereof, the first compression convex rim comprising a surface extended to the front air outlet.

8. The bladeless air fan of claim 7, wherein the first compression convex rim and the first extension form a first included angle between 130 degrees and 160 degrees.

9. The bladeless air fan of claim 8, wherein the first included angle between the first compression convex rim and the first extension is 145 degrees.

10. The bladeless air fan of claim 5, wherein the outer ring compression wall further includes a second extension and a second compression section which includes a second compression convex rim on an inner side thereof, the second compression convex rim comprising a surface extended to the front air outlet.

11. The bladeless air fan of claim 7, wherein the outer ring compression wall further includes a second extension and a second compression section which includes a second compression convex rim on an inner side thereof, the second compression convex rim comprising a surface extended to the front air outlet.

12. The bladeless air fan of claim 10, wherein the second compression convex rim and the second extension form a second included angle between 140 degrees and 175 degrees.

13. The bladeless air fan of claim 12, wherein the second included angle between the second compression convex rim and the second extension is 175 degrees.

14. The bladeless air fan of claim 10, wherein the second compression convex rim further extends to a guiding section which includes a guiding surface to direct the airflow discharging from the front air outlet.

15. The bladeless air fan of claim 14, wherein the guiding surface is a flat surface.

16. The bladeless air fan of claim 14, wherein the guiding surface is an arched surface.

17. The bladeless air fan of claim 5, wherein the inner ring compression wall and the outer ring compression wall form a third included angle ranged from 10 degrees to 15 degrees.

* * * * *